US005651461A

United States Patent [19]

Apps et al.

[11] Patent Number: 5,651,461

[45] Date of Patent: Jul. 29, 1997

[54] STACKABLE LOW DEPTH BOTTLE CASE

[75] Inventors: William P. Apps, Alpharetta; Gerald R. Koefelda, Atlanta, both of Ga.

[73] Assignee: Rehrig-Pacific Company, Inc., Los Angeles, Calif.

[21] Appl. No.: 421,941

[22] Filed: Apr. 13, 1995

Related U.S. Application Data

[63] Continuation-in-part of Ser. No. 384,331, Feb. 1, 1995, and Ser. No. 268,997, Jun. 30, 1994, Pat. No. 5,465,843, which is a continuation-in-part of Ser. No. 18,317, Feb. 3, 1994, said Ser. No. 384,331, is a continuation-in-part of Ser. No. 919,376, Jul. 29, 1992.

[51] Int. Cl.[6] ..... B65D 21/00

[52] U.S. Cl. ..... 206/503; 206/511; 220/509; 220/519

[58] Field of Search ..... 220/503, 504, 220/509, 511, 512, 516, 517, 518, 519; 206/139, 201, 203, 427, 509, 511

[56] References Cited

U.S. PATENT DOCUMENTS

| | | |
|---|---|---|
| D. 147,981 | 11/1947 | Lehman . |
| D. 195,702 | 7/1963 | Russo . |
| D. 201,257 | 6/1965 | Vidal . |
| D. 255,097 | 5/1980 | Carroll et al. . |
| D. 266,709 | 10/1982 | Box . |
| D. 284,841 | 7/1986 | Rowland et al. . |
| D. 285,851 | 9/1986 | Rehrig . |
| D. 289,938 | 5/1987 | Warwick . |
| D. 291,178 | 8/1987 | Toms . |
| D. 304,123 | 10/1989 | Warwick . |
| D. 313,493 | 1/1991 | Apps et al. . |
| D. 317,670 | 6/1991 | Apps . |
| D. 318,552 | 7/1991 | Apps . |
| D. 319,129 | 8/1991 | Apps et al. . |
| D. 320,298 | 9/1991 | Apps et al. . |
| D. 325,279 | 4/1992 | Apps . |
| D. 326,749 | 6/1992 | Apps et al. . |
| D. 327,357 | 6/1992 | Rehrig . |
| D. 327,972 | 7/1992 | Apps et al. . |
| D. 329,931 | 9/1992 | Apps . |
| D. 329,932 | 9/1992 | Apps . |

(List continued on next page.)

FOREIGN PATENT DOCUMENTS

| | | |
|---|---|---|
| 247904 | 8/1962 | Australia . |
| 680197 | 10/1966 | Belgium . |
| 693216 | 7/1967 | Belgium . |
| 965056 | 3/1975 | Canada . |

(List continued on next page.)

OTHER PUBLICATIONS

Exhibit 1: Two photos of a prior art case of Rehrig Pacific for 3 liter PET bottles.
Exhibit 2: Two photos of a prior art case of D.W. Plastics.
Exhibit 3: Two photos of a prior art case of ICS for 3 liter PET bottles.

(List continued on next page.)

*Primary Examiner*—Steven M. Pollard
*Attorney, Agent, or Firm*—Banner & Witcoff, Ltd.

[57] ABSTRACT

A stackable case for retaining and transporting bottles including outer side walls forming an outer shell having a longitudinal axis and a horizontal axis, a case bottom disposed substantially within the outer shell, and a plurality of supports for supporting the outer surfaces of the bottles. The side walls include a lower wall portion and a plurality of spaced upwardly projecting pylons, where four corner pylons define the four corners of the case. A plurality of spaced upwardly projecting columns generally disposed within the outer shell define, in combination with the case bottom, the side walls and the end walls, a plurality of bottle retaining pockets. The columns and the pylons extend above the lower wall portions and below a top surface of the retained bottles. The end walls each include an integrally molded handle structure suspended between an upper portion of adjacent corner pylons to thereby define a generally open end wall area below the handle structure. The handle structure allows the bottle case to be manipulated with either a palm up or palm down orientation of the hand.

16 Claims, 14 Drawing Sheets

U.S. PATENT DOCUMENTS

| | | | |
|---|---|---|---|
| D. 360,758 | 8/1995 | Umiker . | |
| 1,112,943 | 10/1914 | Stone . | |
| 2,064,518 | 12/1936 | Brogden . | |
| 2,411,673 | 11/1946 | Vechey, Jr. . | |
| 2,530,481 | 11/1950 | Rawn, Jr. . | |
| 2,535,493 | 12/1950 | Gerber . | |
| 2,588,805 | 3/1952 | Cross . | |
| 2,626,079 | 1/1953 | Keller . | |
| 2,743,030 | 4/1956 | Read, Jr. . | |
| 2,760,676 | 8/1956 | Knieriem et al. . | |
| 2,840,256 | 6/1958 | Cobb, Jr. . | |
| 2,928,530 | 3/1960 | Sauey . | |
| 2,935,222 | 5/1960 | O'Connell . | |
| 2,970,715 | 2/1961 | Kappel et al. . | |
| 2,974,819 | 3/1961 | Melville . | |
| 2,979,222 | 4/1961 | Levine . | |
| 3,009,579 | 11/1961 | Ettlinger, Jr. . | |
| 3,055,542 | 9/1962 | Russo . | |
| 3,092,284 | 6/1963 | Stout . | |
| 3,148,797 | 9/1964 | Cloyd . | |
| 3,151,762 | 10/1964 | Vidal . | |
| 3,155,268 | 11/1964 | Fogerty et al. . | |
| 3,184,148 | 5/1965 | Poupitch . | |
| 3,247,996 | 4/1966 | Garcia . | |
| 3,283,947 | 11/1966 | Cornelius . | |
| 3,297,190 | 1/1967 | Cloyd . | |
| 3,326,410 | 6/1967 | Asenbauer . | |
| 3,332,574 | 7/1967 | Earp . | |
| 3,333,727 | 8/1967 | Belcher et al. . | |
| 3,333,729 | 8/1967 | Rabb . | |
| 3,334,767 | 8/1967 | Cornelius et al. . | |
| 3,349,943 | 10/1967 | Box . | |
| 3,376,998 | 4/1968 | Cornelius . | |
| 3,379,339 | 4/1968 | Asenbauer . | |
| 3,384,261 | 5/1968 | Austin . | |
| 3,390,801 | 7/1968 | Adomat . | |
| 3,391,814 | 7/1968 | Box . | |
| 3,391,815 | 7/1968 | Box . | |
| 3,392,869 | 7/1968 | Needt . | |
| 3,416,694 | 12/1968 | Bebb . | |
| 3,447,715 | 6/1969 | Beney . | |
| 3,517,852 | 6/1970 | Schoeller . | |
| 3,547,309 | 12/1970 | Pusey et al. . | |
| 3,638,824 | 2/1972 | Sekiguchi et al. . | |
| 3,651,976 | 3/1972 | Chadbourne . | |
| 3,701,449 | 10/1972 | Schoeller . | |
| 3,734,341 | 5/1973 | Levenhagen . | |
| 3,759,416 | 9/1973 | Constantine . | |
| 3,812,996 | 5/1974 | Bunnell . | |
| 3,865,239 | 2/1975 | Herolzer et al. . | |
| 3,949,876 | 4/1976 | Bridges et al. . | |
| 3,998,327 | 12/1976 | Box | 220/519 X |
| 4,027,796 | 6/1977 | Martin . | |
| 4,037,722 | 7/1977 | Bremer . | |
| 4,040,517 | 8/1977 | Torokvei . | |
| 4,071,162 | 1/1978 | Steinlein et al. . | |
| 4,095,720 | 6/1978 | Delbrouck et al. . | |
| 4,101,049 | 7/1978 | Wallace et al. . | |
| 4,105,117 | 8/1978 | Atkin et al. . | |
| 4,120,444 | 10/1978 | Gray . | |
| 4,161,259 | 7/1979 | Palafox . | |
| 4,162,738 | 7/1979 | Wright . | |
| 4,202,448 | 5/1980 | Jaeger et al. . | |
| 4,204,596 | 5/1980 | Davis . | |
| 4,319,685 | 3/1982 | David . | |
| 4,344,530 | 8/1982 | deLarosiere . | |
| 4,349,121 | 9/1982 | Lafferty . | |
| 4,410,099 | 10/1983 | deLarosiere . | |
| 4,416,373 | 11/1983 | deLarosiere . | |
| 4,520,941 | 6/1985 | Hagan et al. . | |
| 4,548,320 | 10/1985 | Box . | |
| 4,619,371 | 10/1986 | Rehrig . | |
| 4,671,411 | 6/1987 | Rehrig et al. . | |
| 4,700,836 | 10/1987 | Hammett . | |
| 4,700,837 | 10/1987 | Hammett . | |
| 4,759,451 | 7/1988 | Apps . | |
| 4,773,554 | 9/1988 | Warwick . | |
| 4,789,063 | 12/1988 | Hammett . | |
| 4,823,955 | 4/1989 | Apps . | |
| 4,848,580 | 7/1989 | Wise . | |
| 4,899,874 | 2/1990 | Apps et al. | 206/511 X |
| 4,928,841 | 5/1990 | Arthurs | 220/519 X |
| 4,932,532 | 6/1990 | Apps et al. . | |
| 4,978,002 | 12/1990 | Apps et al. . | |
| 5,031,774 | 7/1991 | Morris et al. . | |
| 5,060,819 | 10/1991 | Apps . | |
| 5,071,026 | 12/1991 | Apps . | |
| 5,105,948 | 4/1992 | Morris et al. | 220/519 X |
| 5,184,748 | 2/1993 | Apps . | |
| 5,305,884 | 4/1994 | Apps et al. | 220/519 X |
| 5,316,172 | 5/1994 | Apps et al. | 220/519 |
| 5,335,814 | 8/1994 | Hepp . | |
| 5,421,447 | 6/1995 | Hammett . | |
| 5,465,843 | 11/1995 | Koefelda | 220/509 X |
| B1 4,344,530 | 3/1988 | deLarosiere . | |

FOREIGN PATENT DOCUMENTS

| | | |
|---|---|---|
| 1109433 | 9/1981 | Canada . |
| 99827 | 2/1984 | European Pat. Off. . |
| 1285689 | 1/1962 | France . |
| 1351218 | 12/1963 | France . |
| 1518610 | 2/1968 | France . |
| 2401087 | 3/1979 | France . |
| 1207268 | 12/1965 | Germany . |
| 1486412 | 5/1969 | Germany . |
| 6505562 | 10/1966 | Netherlands . |
| 943947 | 12/1963 | United Kingdom . |
| 1032916 | 6/1966 | United Kingdom . |
| 1115343 | 5/1968 | United Kingdom . |
| 1120067 | 7/1968 | United Kingdom . |
| 1152038 | 5/1969 | United Kingdom . |
| 1312701 | 4/1973 | United Kingdom . |
| 1319726 | 6/1973 | United Kingdom . |
| 1330778 | 9/1973 | United Kingdom . |
| 2079256 | 1/1982 | United Kingdom . |
| 2135278 | 8/1984 | United Kingdom . |
| 2158044 | 11/1985 | United Kingdom . |
| WO82/01536 | 5/1982 | WIPO . |
| WO92/15758 | 12/1990 | WIPO . |

OTHER PUBLICATIONS

Exhibit 4: Three photos of a prior art case of ICS for 2 liter PET bottles.

Exhibits A & B: Two photos of an embodiment of U.S. Pat. No. 4,773,554 to Warwick.

Exhibits D–F: Three photos of a bottle neck resting type crate with projections above the outer side walls.

Exhibits G–J: Four photos of a bottle neck resting type crate without projections above the outer side walls.

Exhibit K: One photo of a bottle neck resting type crate with different height outer side walls.

Exhibit L: Four photos of an embodiment of Great Britain Patent Publication No. 2,158,044 & U.S. Design Patent No. D289,938.

Exhibit M: Copy of a brochure illustrating an embodiment of GB No. 2,158,044/U.S. D289,938.

Exhibit N: Copy of a brochure illustrating an embodiment of U.S. Patent No. 4,773,554 & an embodiment of GB No. 2,158,044/U.S. D289,938.

Exhibit O: Four photos of an embodiment of U.S. Patent No. 4,344,530 to deLarosiere.
Exhibit P: Two photos of an embodiment of U.S. Patent No. 4,700,837 to Hammett.
Exhibit Q: Four photos of an embodiment of U.S. Patent No. 4,344,530 for 3–liter PET bottles.
Exhibit R: Four photos of a modified embodiment of U.S. Patent No. 4,700,837 for 3–liter PET bottles.
Exhibit S: Three photos of an embodiment of U.S. Patent No. 3,392,869 to Needt.
Exhibit T: Four photos of a prior art crate of Rehrig–Pacific Company, Model No. PLBC–8–2L–HD.
Exhibit U: Four photos of a prior art crate of Rehrig–Pacific Company, Model No. PLBC–6–2L–HD.
Exhibit V: Four photos of a prior art crate of Rehrig–Pacific Company, Model No. PLBC–8–2L–PET–QD.
Exhibits W & X: Brochures including a PBC–6–2L (LO) crate for 2–liter bottles.
Exhibit Y: Brochure and photo, "Interlocking bottom grid. Cross stackable".
Exhibit Z: One–page brochure disclosing a prior art 2–liter PET case having a plurality of notches on the top wall.
Exhibit AA: One–page brochure illustrating a prior art 2–liter PET case.

STACKABLE LOW DEPTH BOTTLE CASE

CROSS-REFERENCE TO RELATED APPLICATION

This application is a continuation-in-part of: 1) pending U.S. application Ser. No. 08/384,331 filed Feb. 1, 1995, which is a continuation-in-part of U.S. application Ser. No. 07/919,376, filed Jul. 29, 1992, pending; and 2) U.S. application Ser. No. 08/268,997, filed Jun. 30, 1994, now U.S. Pat. No. 5,465,843, which is a continuation-in-part of U.S. application Ser. No. 29/018,317, filed Feb. 3, 1994, pending.

TECHNICAL FIELD

The present invention relates to low depth stackable bottle cases for use in retaining and transporting bottles. More particularly, the present invention relates to beverage bottle cases that combine low depth with high stability for stored bottles, full label visibility for display purposes, an easily gripped handle structure, and a cross-locking ability for securing a plurality of stacks of empty cases.

BACKGROUND OF THE INVENTION

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear surprisingly high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along the symmetric axis. However, if a compressive load is applied to a conventional PET beverage bottle along a direction other than the symmetry axis of the bottle, the bottle tends to buckle. This tendency of conventional PET bottles to give way under off-axis compressive loads is particularly pronounced for large capacity bottles, such as the two-liter bottle widely used for marketing soft drinks.

Soft drink bottles are ordinarily packaged by bottlers in cases or other containers, several bottles to the case, for shipment to retailers or for storage. The term "case", "crate" or "tray" is used interchangeably herein to include all cases, crates, trays and similar containers having a bottom and peripheral side wall structure. Cases of bottles are customarily stacked on top of each other. In storage warehouses, columns of cases are frequently stacked on pallets which can be lifted and moved about by fork-lift trucks. The stacks of cases on the pallets must therefore be particularly stable in order to remain standing in the face of the jostling inherent in being moved about. A technique for interconnecting stacks of empty cases, called "cross-stacking," is often used to improve the stability of empty cases loaded on a warehouse pallet. Cross-stacking generally involves stacking rectangular bottle cases to build up a layered structure, with each layer having cases oriented parallel to each other and with the adjacent layers being oriented at right angles to each other. Thus, since the adjacent layers are perpendicular, each case in the cross-stacked layer rests on at least two cases in the layer below. As a result, the cases of the cross-stacked layer tend to keep the cases on which they rest from moving apart from each other. The cross-stacked layers therefore stabilize the stacked structure.

Because of the tendency of conventional PET beverage bottles to buckle under off-axis loads, attempts to stack cases of these bottles give rise to serious problems. Bottles can tilt away from vertical alignment upon stacking if conventional partitioned cases having low side walls are used to contain the bottles. Tilted bottles in the lower cases of a stack can buckle and give way, causing the stack to fall. Even absent buckling, the tendency of bottles to tilt in conventional low-sided cases causes problems. Tilting generally places an undesirably low limit on the number of tiers in a stack since the tilting of bottles in one case can cause the next higher case in the stack to tilt. This leads to instability if too many tiers are included in the stack.

Previously, these problems were dealt with by packaging beverage bottles in corrugated-paper cartons having high sides, often equal in height to the height of the bottles. Two-liter PET bottles filled with soft drinks were often packaged in enclosed corrugated paper cartons for storage and shipment. Although the high sides of these paper cartons reduce the incidence of tilting and provide additional support when the cartons are stacked, the cartons are expensive. The cost of the cartons cannot ordinarily be distributed over a number of repeated uses since corrugated-paper cartons generally are not rugged enough for reuse and therefore they are usually discarded by the retailer.

One solution to the problems of full depth corrugated-paper cartons is plastic full depth cases; that is, plastic cases having peripheral sidewalls approximately the same height as the bottles. In plastic full depth cases, the sidewalls are the load bearing surfaces. Full depth plastic cases, however, have numerous disadvantages. They are expensive to manufacture, they are expensive to ship and to store empty in a warehouse as they require a large amount of space, and full depth cases also totally surround the bottles and prevent display of the bottles.

To overcome these problems plastic low depth cases have been used. A low depth case is one in which the side walls are lower than the height of the stored bottles, and in which the bottles support the weight of additional cases stacked on top. However, these too have drawbacks. For example, some low depth cases, require additional structure to hold the bottles and insure complete bottle stability, even though the case depth is more than 25% of the height of the bottles.

Various plastic reusable bottle carriers are known in the art. One reusable bottle carrier is disclosed in U.S. Pat. No. 3,055,542 to Russo. The bottle carrier can be made of a plastic, and is assembled from two pieces: a handle and a carrier body having six cups for soft drink bottles. In order to stack the bottle carriers when empty, the handles must be removed. This is very inconvenient and time consuming. The '542 bottle carrier is also seriously limited regarding stacking loaded carriers. It cannot be stacked in a conventional cross-stacked structure because, as illustrated therein, the spacing between the bottles in the carriers is different in the directions parallel and perpendicular to the handle of the carrier.

Kappel U.S. Pat. No. 2,970,715 is one of the earlier embodiments of molded plastic low depth bottle carrying cases. Each bottle rests on a raised flat surface within an individual compartment. The bottom of the case is formed with recesses for receiving bottle tops when loaded cases are vertically stacked. However, Kappel does not indicate the size of the carrying case relative to the bottles being carried.

In Bunnell, U.S. Pat. No. 3,812,996, a reusable plastic bottle carrying case for beer bottles is disclosed. The case is designed with a plurality of bottle compartments having flat bottom walls. The cases are designed to be cross-stacked; the cases are dimensioned so that the center-to-center distance between adjacent bottles within a case is the same as the center-to-center distance between adjacent bottles in adjacent cases in abutting relationship. Thus, the vertical axes of the bottles in adjacent layers are co-linear. Although a plurality of loaded carrying cases is designed to be vertically stackable with the weight of upper cases supported by the bottles within lower cases, the lower surface of the bottom wall of the case is flat. Thus, there is no structure for assuring a proper alignment or centering of one case with an upper or lower case.

Garcia, U.S. Pat. No. 3,247,996 discloses a plastic bottle container for milk bottles. The container is shorter than the bottles which extend above the top surface of the container walls. In Garcia, the bottles, rather than the walls of the container, are load bearing. Indented circular portions may be formed in the bottom wall to receive bottle tops when containers are vertically stacked. Like many prior art bottle carriers, the Garcia container has sides of reduced height from those of a standard full depth case; also, it can be used with a variety of bottles. However, the case is not a low depth case and is more expensive than low depth cases. It also does not have the display capabilities of low depth cases.

A more recent attempt to solve the problem of providing reusable, low depth, cross-stackable PET bottle cases is disclosed in U.S. Pat. No. 4,344,530 to deLarosiere. The '530 patent has many of the features and problems of Garcia and discloses a plastic PET bottle case that is cross-stackable and has a very low depth as shown in the figures. This low depth is disclosed as being approximately ⅙ the height of the PET bottles, or approximately 2 inches. However, in practice, this depth is insufficient because the large degree of lateral instability does not prevent bottles from tipping over. Additionally, the bottle retaining pockets are required to have a raised annular bottle seat ting which fits within the inner indentation formed in the base of many bottles to insure bottle stability. This does not permit all PET bottles to rotate within the bottle pockets for display purposes. Additionally, it does not permit one piece bottles (i.e., petaloid bottles that do not have a base indentation) to be adequately retained.

The commonly assigned U.S. Pat. Nos. 4,899,874 and 4,978,002, the contents of which are hereby incorporated by reference, disclose a low depth bottle case for two-liter bottles that is cross-stackable when empty if the upper cross-stacked cases are properly positioned. In addition, in the embodiment disclosed the substantially flat upper surface across the bottle retaining pockets permits one piece petaloid bottles and bottles with base indentations to be retained. The low height of the case sidewalls and the columns above the case sidewalls also allow the display of the bottle labels to the consumer. However, because of the low depth and the substantially flat upper surface across the bottle retaining pocket, a generally snug fit is required between the bottle pocket and the bottle and therefore, there is a limit on the range of bottle diameters which can be retained in a stable stack.

The trend in the bottling industry today is to manufacture two-liter bottles as inexpensively as possible. This means reducing the amount of plastic in the bottle, but still maintaining sufficient bottle strength to support fully loaded cases stacked thereabove. In order to accomplish this task, the newest two-liter bottles are made to have smaller diameters and a slightly greater height than their predecessors. The result is a lightweight two-liter bottle having a slimmer overall profile than previous two-liter bottles. The lightweight bottle, however, due to its slimmer profile and increased height, does not perform ideally within the bottle pockets of the low-depth two-liter cases discussed above.

SUMMARY OF THE INVENTION

These and other problems of the prior art are overcome by the stackable low depth case of the present invention. The stackable low depth case for retaining and transporting bottles has opposing side walls and opposing end walls that form an outer shell having a case bottom disposed substantially within the outer shell. The side walls include a lower wall portion and a plurality of spaced upwardly projecting pylons, four corner pylons defining four corners of the case. A plurality of spaced upwardly projecting columns generally disposed within the outer shell define, in combination with the case bottom, the side walls and the end walls, a plurality of bottle retaining pockets. The columns and the pylons extend above the lower wall portions and below a top surface of the retained bottles. The end walls each include an integrally molded handle structure suspended between an upper portion of adjacent the corner pylons to thereby define a generally open end wall area below the handle structure.

The integrally molded handle area enables easier manipulation of the case and alleviates undue fatigue to the user's hands and wrists as well as the risk of wrist injuries such as carpal tunnel syndrome. The handle area allows the case to be lifted with a person's palm facing upwards, for when the case is on the ground for example and to also be moved with a person's palm facing downwards, for when the case is stacked above the person's head for example. As a result of the placement of the handle area, the pocket-to-pocket distance between the end pockets of adjacent cases is no longer equal to the pocket-to-pocket distance within the cases. Thus, in order to achieve a stable loaded condition, a resting and guiding structure on the bottom of the case includes a rib formation having a longitudinal centerline that is offset from the centerline of the bottle retaining pockets.

Various additional advantages and features of novelty which characterize the invention are further pointed out in the claims that follow. However, for a better understanding of the invention and its advantages, reference should be made to the accompanying drawings and descriptive matter which illustrate and describe preferred embodiments of the invention.

DETAILED DESCRIPTION OF THE PREFERRED EMBODIMENTS

Figure 1:
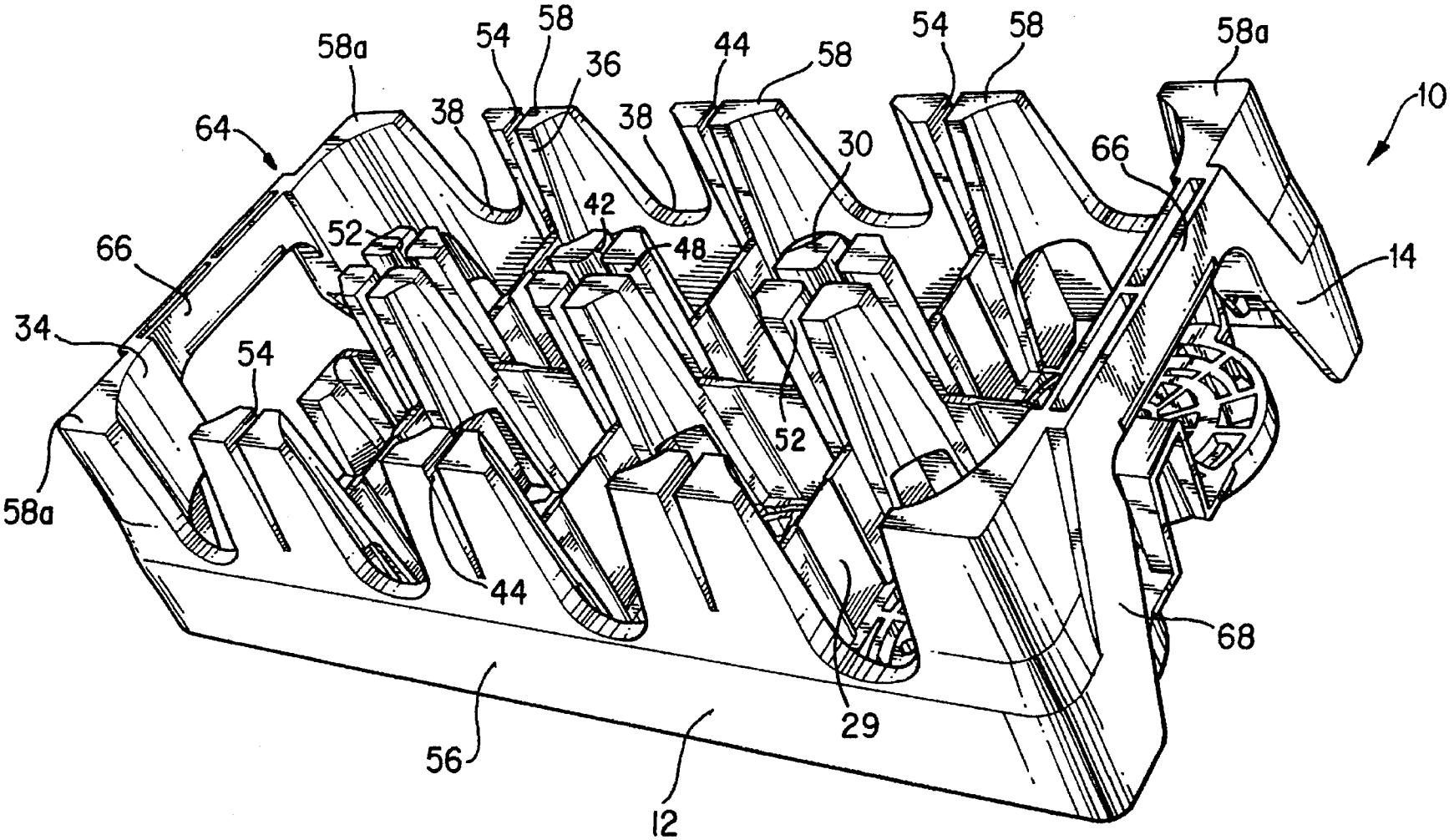
FIG. 1 is a top perspective view of a stackable low depth case according to the present invention.

As shown in FIGS. 1–9, the stackable low depth bottle case 10 has two basic elements: a floor structure 20 and a wall structure 11. Wall structure 11 includes four side walls 12, 14, 16, 18. Side walls 12, 16 are relatively long and extend the length of case 10 whereas side walls or end walls 14, 18 are relatively short and extend the width of case 10. Case 10 is rectangular and is therefore symmetric about both center lines which bisect the bottom surface. The depth or height of side walls 12, 14, 16, 18 is relatively low compared to the height of the bottles retained therein. The ratio of the length of long side walls 12, 16 to the length of short end walls 14, 18 is substantially equal to the ratio of the number of bottles the case holds in the lengthwise direction to the number of bottles the case holds in the widthwise direction. For example, an 8-bottle case is approximately twice as long as it is wide and holds bottles in a 4×2 relationship. This length to width relationship will be discussed further below.

Figure 2:
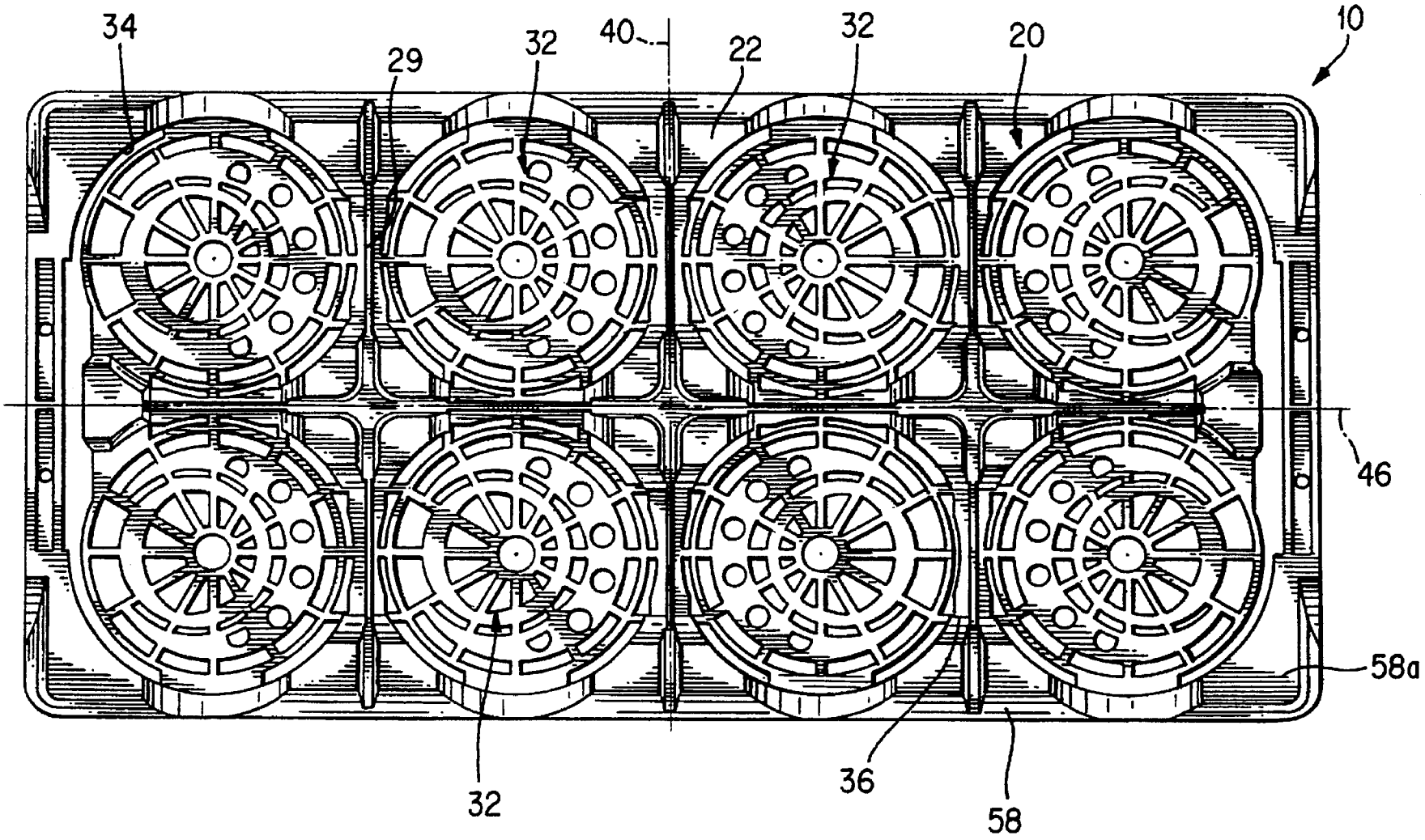
FIG. 2 is a top plan view thereof.

As best shown in FIG. 2, case 10 also includes floor structure or bottom portion 20 attached to side walls 12, 14, 16, 18 to form the outer shell of case 10. Preferably, case 10 is made from plastic and is molded integrally as a single component. Bottom portion 20 has an upper surface 22 and a lower surface 24. Upper surface 22 is substantially flat in order to accommodate a variety of bottles, including one piece petaloid bottles and two piece base cup bottles. Lower surface 24 is formed as a plurality of closure acceptance areas 25 defined by generally concave concentric circular portions 26, each having a central retaining opening 28 disposed therein. The number of closure acceptance areas corresponds to the number of bottles the case is designed to retain. The function of circular concave portions 26 and central retaining openings 28 will be described in detail below. In addition, the periphery of bottom portion is finished with a beveled edge 35 to facilitate handling by allowing hand trucks to slide easily under the case.

Side walls 12, 16 each include a lower wall portion 56 and a plurality of pylons 58. It will be understood in the present invention that "pylon" denotes an upwardly extending hollow column or post. In addition to the side wall pylons 58, a corner pylon **58*a* is disposed in each corner of case 10. Pylons 58, 58*a* are integrally formed with lower wall portion 56 and floor structure 20. Pylons 58, 58*a* are preferably hollow and generally extend upward from and beyond a top edge of interior lower wall portion 62. Pylons 58, 58*a* are also integral with exterior lower wall portion 60. Interior lower wall portion 60 and exterior lower wall portion 62 combine to provide a double-walled construction to case 10 such that they are respectively contiguous with the interior and exterior surfaces of the side and corner pylons. This construction ensures that case 10** will have sufficient strength and rigidity for a variety of handling situations.

A plurality of vertical walls 29 and columns 30 are disposed within side walls 12, 14, 16, 18. For clarity of the present invention, "columns" denote an upwardly extending hollow column or post within the interior area of the case and "pylon" denotes the same around the periphery of the case. In a preferred embodiment, vertical walls 29 extend to the top surface of bottom portion 20. The side edges of vertical walls 29 abut pylons 58 and columns 30 and help to secure the interior surfaces of pylons 58 and columns 30 to bottom portion 20. Vertical walls 29, columns 30, and pylons 58, **58*a*, when combined with upper surface 22 of bottom portion 20 and sidewalls 12, 14, 16, 18, define a plurality of bottle retaining pockets 32. Columns 30 and pylons 58, 58*a* extend above bottom portion 20 a distance approximately equal to 40 percent of the height of the bottles to be retained in case 10. For example, where cases 10 are shaped to retain the slimmer lightweight 2-liter bottles, columns 30 and pylons 58, 58*a* define a case that is approximately 5.25 inches tall. Columns 30 and pylons 58, 58*a* extend upwardly approximately three inches above the lower wall portions 56 of side walls 12, 16. This increases the effective height of the case while maintaining high bottle visibility and low manufacturing costs. In addition, since the taller columns and pylons increase the lateral stability of the bottle within bottle retaining pocket 32**, a greater variance in the diameters of the bottles is obtained because as snug of fit is no longer necessary, as in the prior art cases.

Pylons 58 are disposed along the walls 12, 16 and columns 30 are disposed away from the walls, centrally within bottom portion 20. Pylons **58*a* disposed in the corners between two adjacent walls have one curved surface 34. Pylons 58 disposed on sidewalls 12, 16 have two curved surfaces 34 and one flat surface 36 disposed therebetween. The two curved surfaces 34 help define two separate and adjacent bottle retaining pockets 32. Flat surface 36 is disposed between these two bottle retaining pockets. Columns 30 that are disposed centrally within bottle portion 20 are octagonally shaped. These columns 30 have four alternating curved surfaces 34 and four alternating flat surfaces 36. The four curved surfaces 34 define portions of four bottle retaining pockets 32 and the four flat surfaces 34 separate these pockets. Four curved surfaces 34 on four separate columns 30 or pylons 58 form the four corners of interior bottle retaining pocket 32. Exterior bottle retaining pockets formed by corner pylons 58*a*, side pylons 58, and columns 30 are defined by only three corners since there are no side pylons on end walls 14, 18**, the reasons for which are discussed below.

As shown in FIG. 1, column 30 and pylons 58 disposed along a center line 40 of the length of the case 10 (along the transverse axis of case 10) include recesses 42, 44, respectively, which extend downwardly to a height which substantially equals the height of vertical walls 29. Columns 30 disposed along a center line 46 of the width of the case (along the longitudinal axis of case 10) also include recesses 48 which extend downwardly to a height substantially equal to the height of vertical walls 29. Further, columns 30 and pylons 58 disposed along an axis parallel to center line 40 along the transverse axis of the case include recesses 52, 54, respectively. As discussed below, these recesses are for receiving ribs of an identical upper case and provide flexibility in the stacking of identical cases.

The upper surface 22 of bottom portion 20 within bottle retaining pockets 32 is substantially flat. This permits retention of bottles regardless of the configuration of the bottom of the bottles. Also, this allows petaloid bottles to be rotated within the bottle retaining pockets to facilitate display of the product. The low depth feature of case 10 as well as the windows or depressions 38 cut out from side walls 12, 16 further enhance display of the product labels in a retail setting.

Figure 17A:
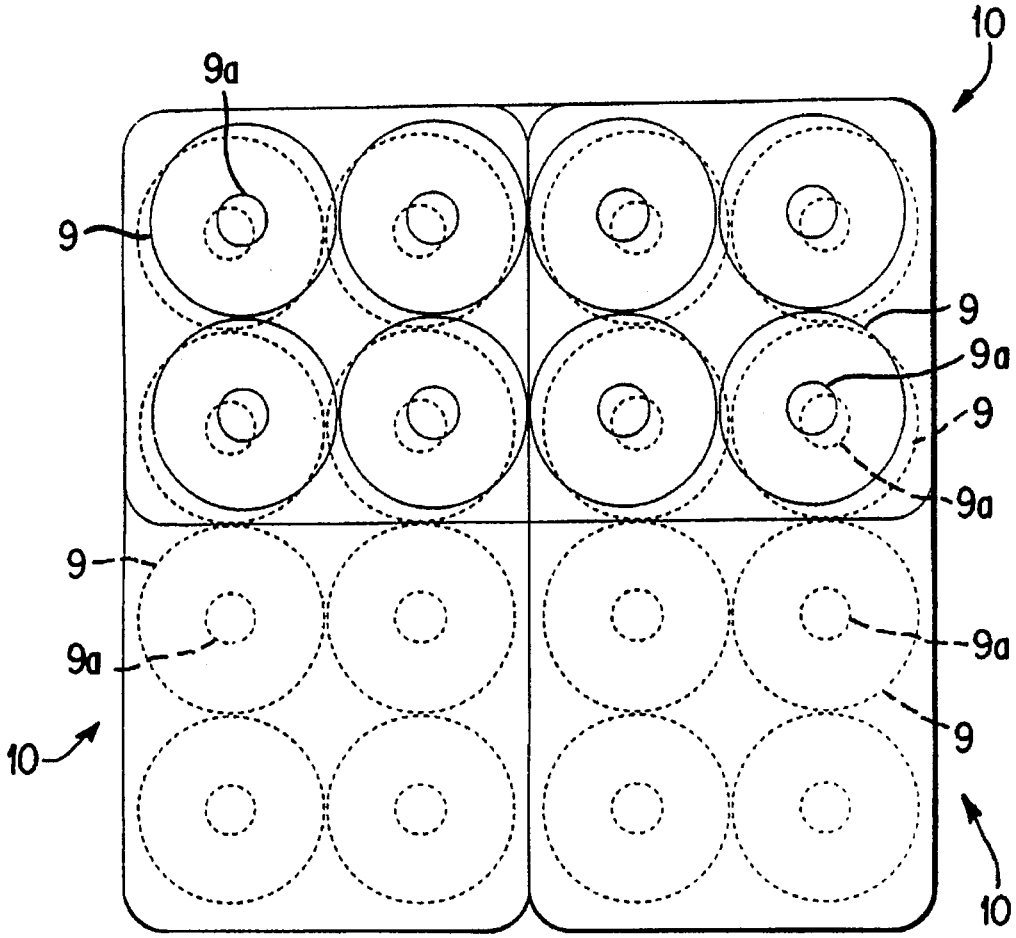
FIGS. 17A–B is a schematic illustration of the location of bottle tops when stacked in the case of FIG. 1.
Figure 17B:
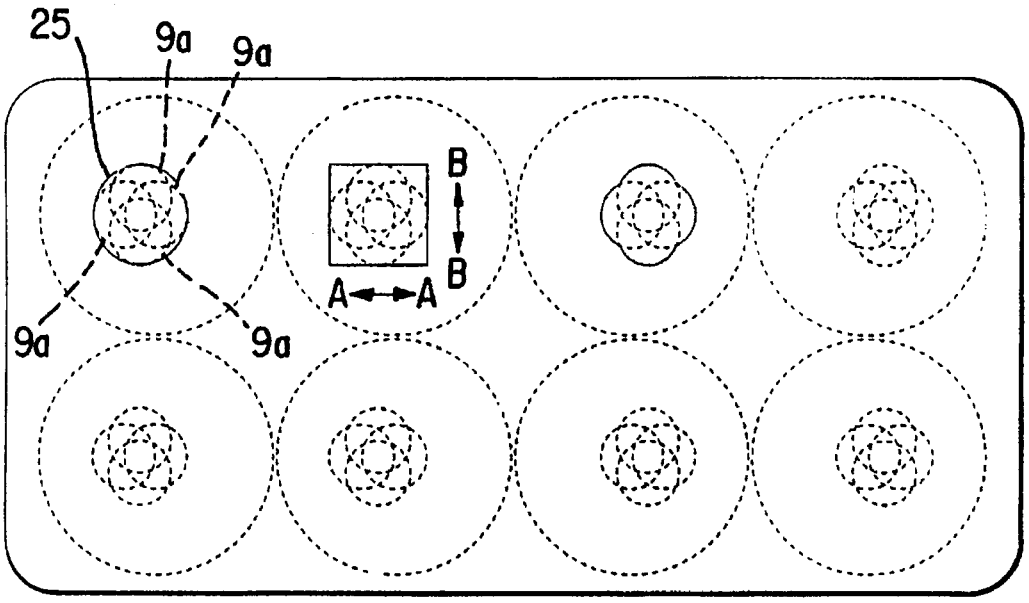

In prior art cases, the center-to-center distances between adjacent bottle retaining pockets has generally been equal. Thus, the symmetrical and conical shape of the circular portions aligned the bottle tops with the central retaining openings, regardless of whether the cases were column stacked or cross-stacked. In the present invention, however, the positioning of handle potions 64 disrupts the equality of center-to-center distances between adjacent end bottle retaining pockets in adjacent cases with abutting side walls. With reference to FIG. 17A, two lower cases 10 and an identical upper cross-stacked case 10 are illustrated. The position of the bottles 9 and the bottle tops 9*a* thereof are shown by the large and small circles, respectively. As illustrated, the bottle tops 9*a* of the cross-stacked case do not align with the bottle tops therebelow. FIG. 17B illustrates the four possible positions of bottle tops 9*a* in an upper cross-stacked case. Therefore, taking the non-equidistant end pockets into consideration, the present invention utilizes a closure acceptance area to accommodate all possible positions of the bottle tops when a plurality of identical cases are stacked and cross-stacked. As outlined in FIG. 17B, the closure acceptance 25 is offset from the longitudinal centerline of the bottles and can have a circular shape, a rectangular shape, or preferably, a cloverleaf shape.

Figure 3:
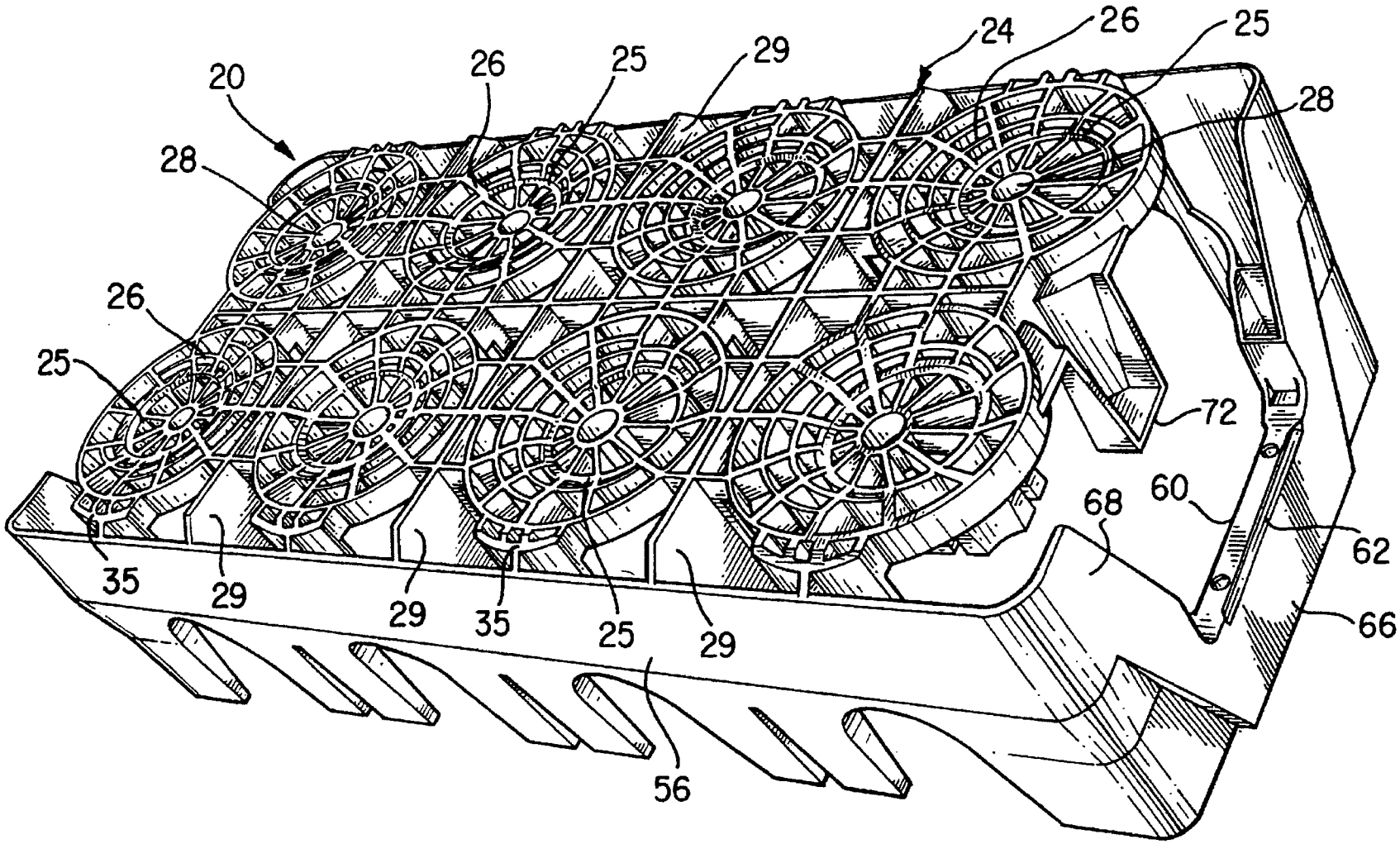
FIG. 3 is a bottom perspective view thereof.
Figure 4:
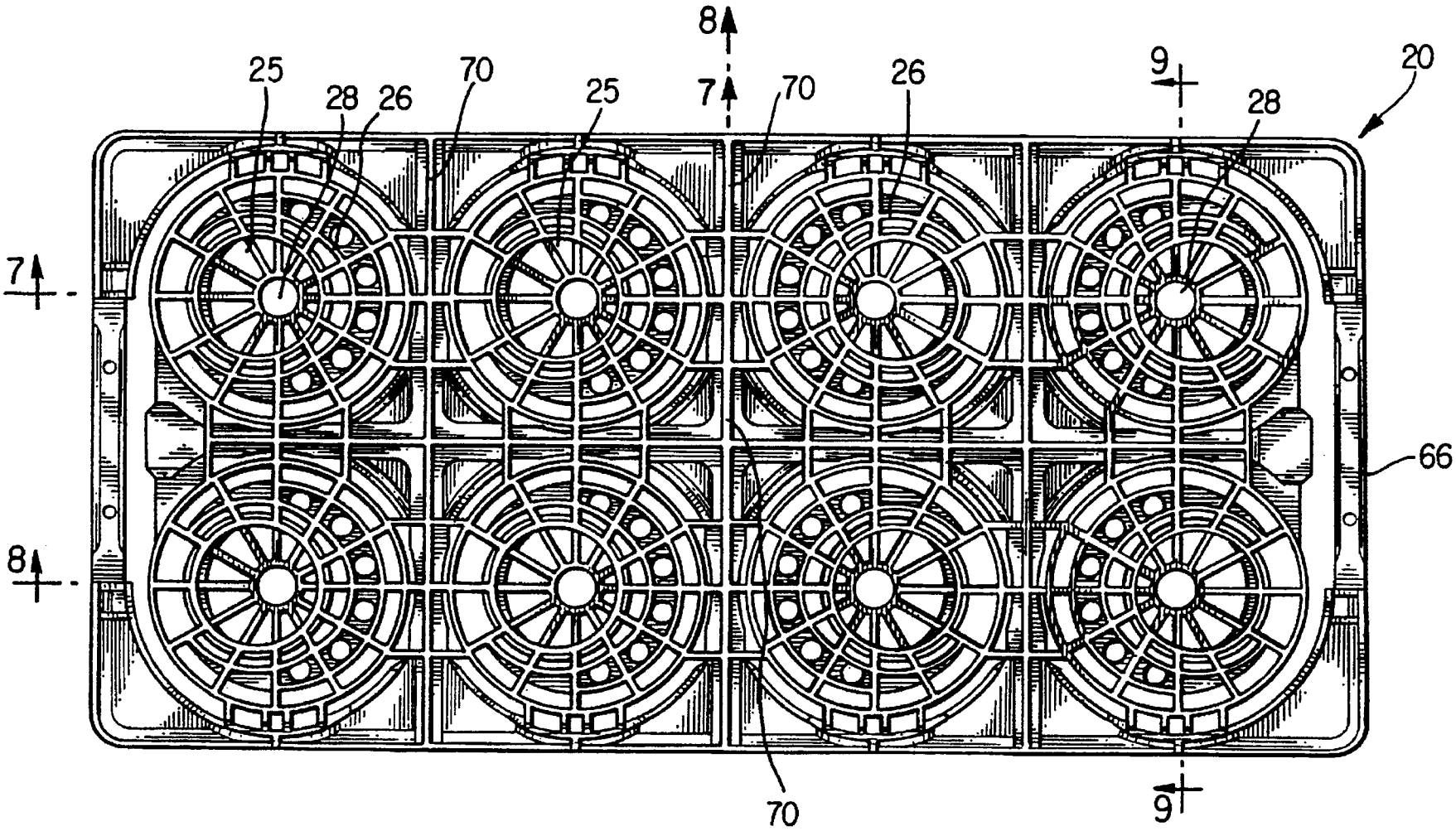
FIG. 4 is a bottom plan view thereof.
Figure 5:
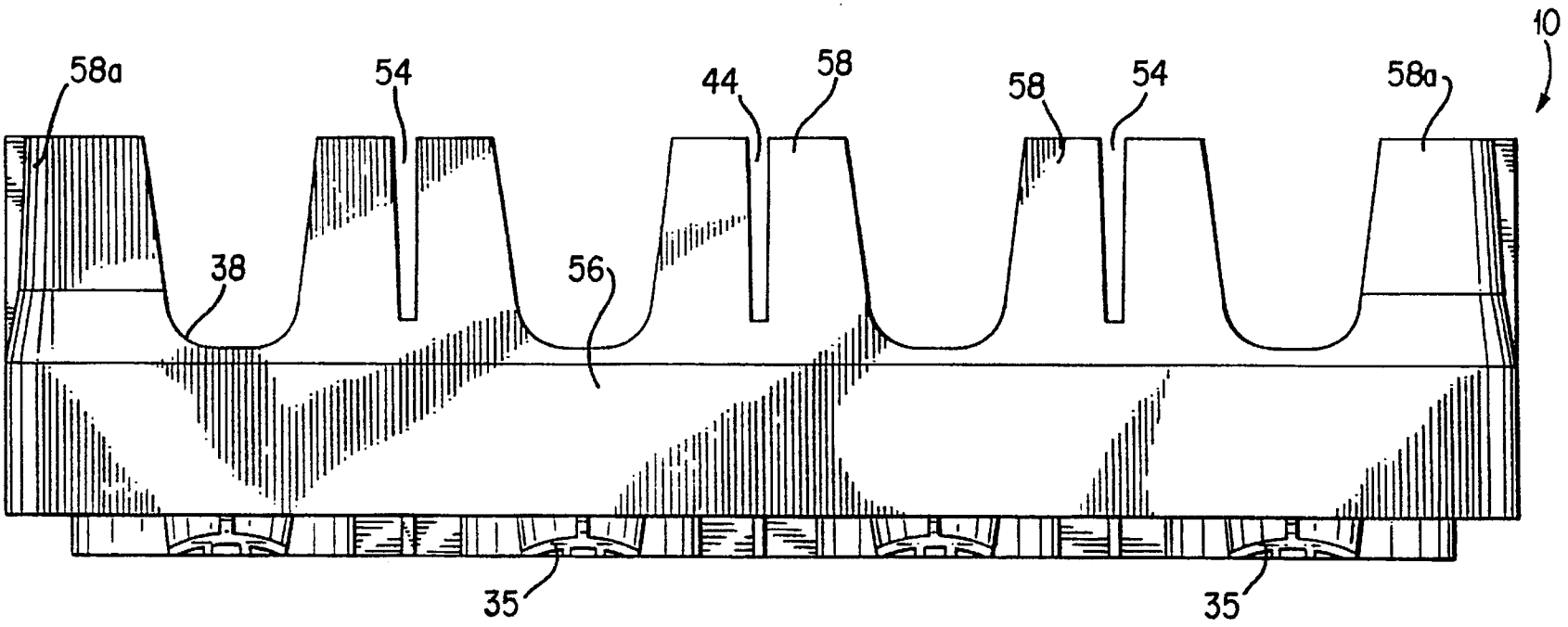
FIG. 5 is a side elevational view thereof.
Figure 6:
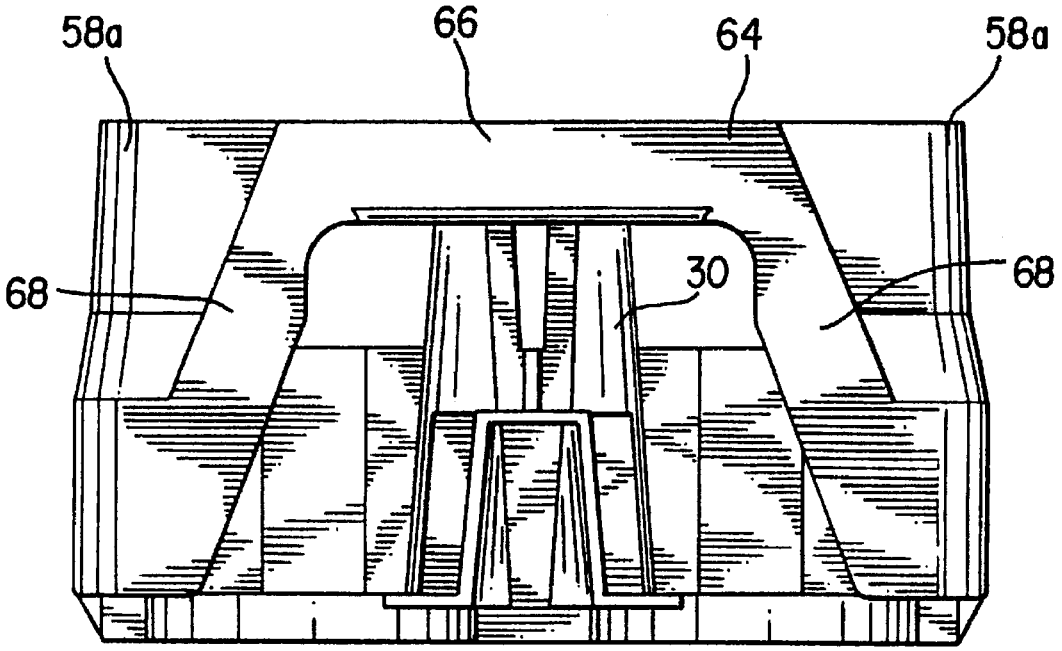
FIG. 6 is an end elevational view thereof.
Figure 7:
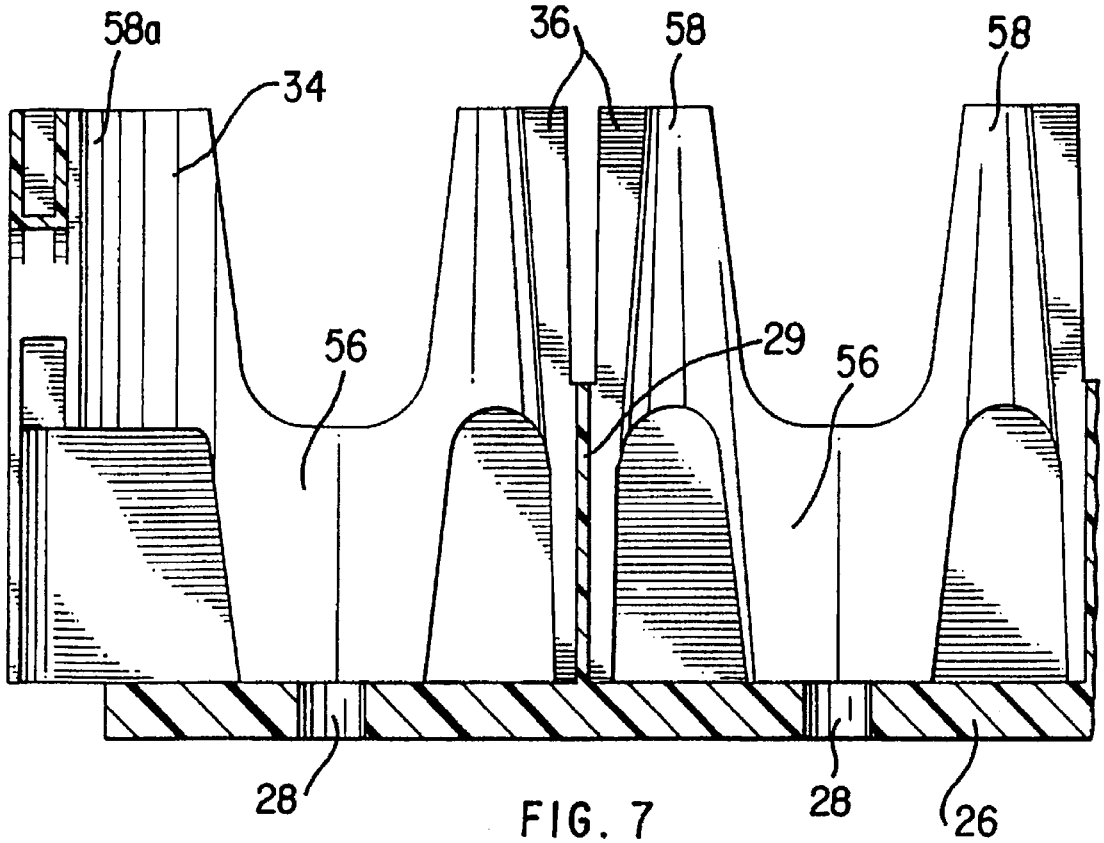
FIG. 7 is a cross-sectional view taken along the line 7—7 of FIG. 4.
Figure 8:
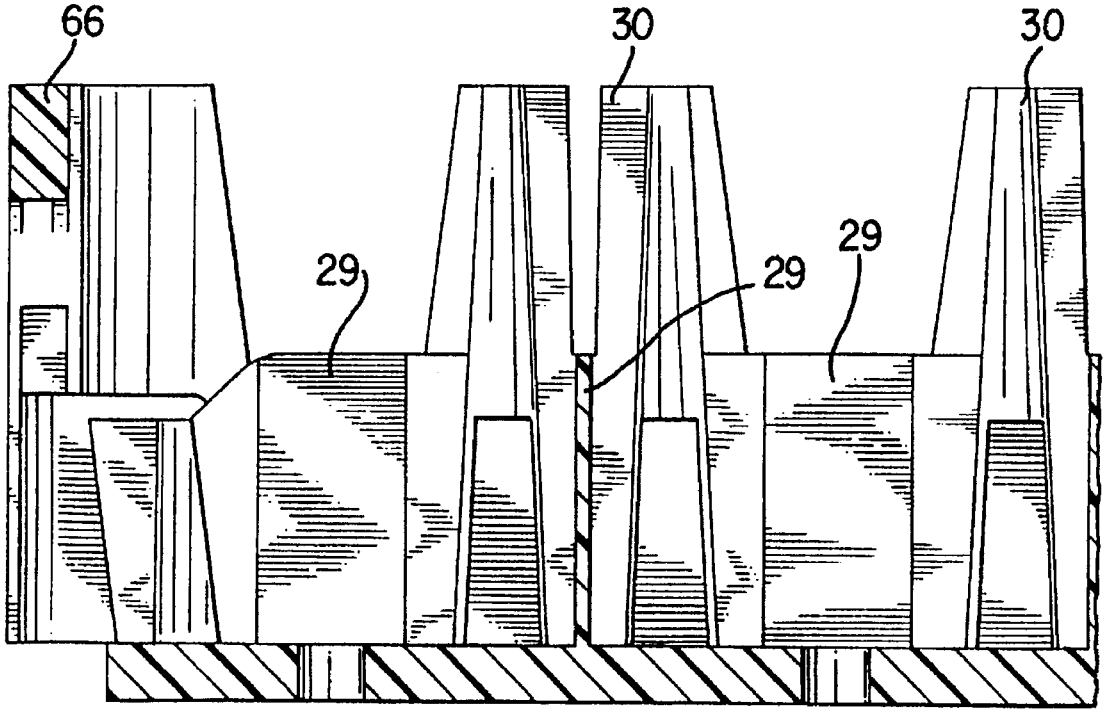
FIG. 8 is a cross-sectional view taken along the line 8—8 of FIG. 4.
Figure 9:
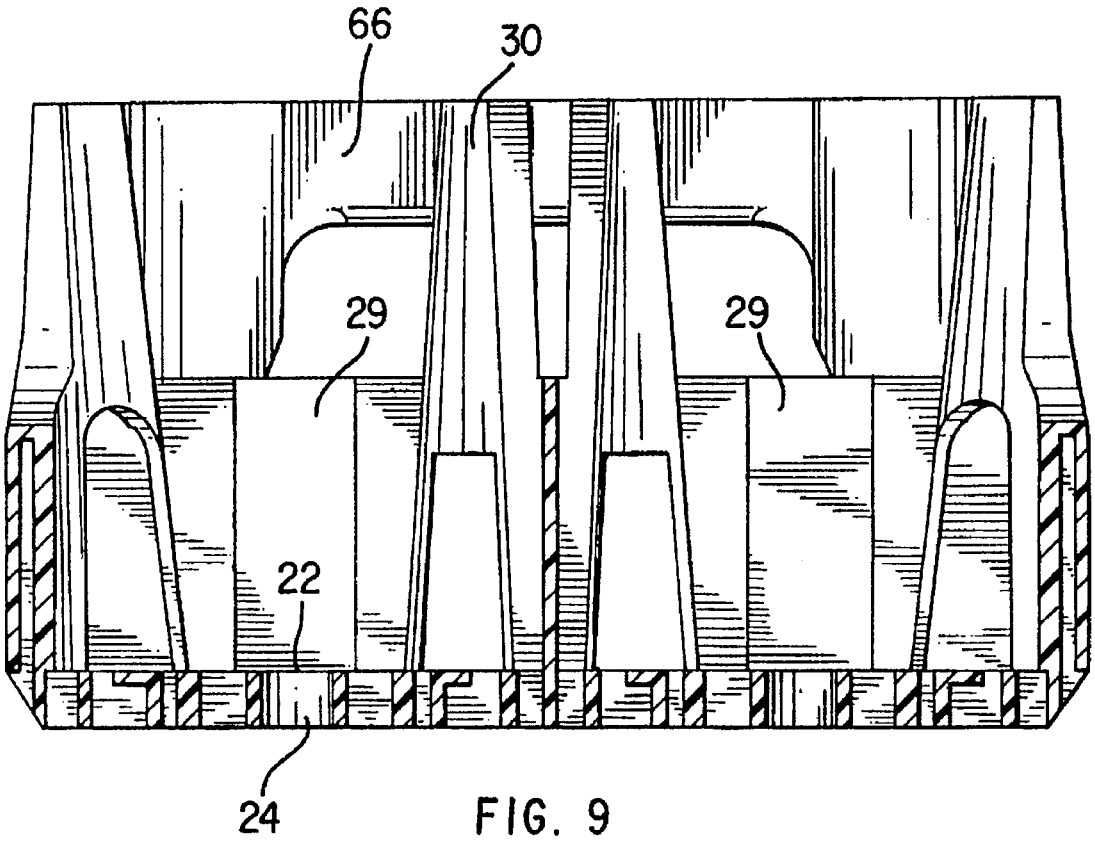
FIG. 9 is a cross-sectional view taken along the line 9—9 of FIG. 4.

The closure acceptance areas of lower surface 24, shown clearly in FIG. 3 for the first embodiment of the present invention, allow cases 10 filled with bottles to be vertically stacked for transportation, storage, and display purposes. Circular concave portions 26 are formed offset from the centerline of the retained bottles by ribs or projections which define the circular concave shape. These ribs also form central retaining opening 28. Referring also to FIG. 4, central retaining opening 28 is sized to receive the bottle top of a bottle which is disposed in a lower case 10. The bottle top fits adjacent central retaining opening 28 so that central retaining opening 28 retains the bottle top in position against lower surface 24. The conical shape of circular concave portion 26 assists the bottle top to abut central retaining opening 28. When an upper case 10 is being positioned on loaded lower case 10, often bottle tops will not precisely line up with respective central retaining openings 28. However, the bottle tops will contact the offset circular concave portions 26 and, because of the concave shape, be guided into central retaining openings 28. Thus, even though the center-to-center distances between adjacent bottle retaining pockets are not substantially equal between adjacent cases, the use of offset concentric circles in concave portion 26 enables the cases to be column stacked or cross-stacked in a stable pallet load.

Both the circular closure acceptance area illustrated in FIG. 4 and the square closure acceptance area schematically shown in FIG. 17B substantially restrain the end-to-end movement of the bottles in the stacked cases in the direction of arrow "A". The side-to-side movement in the direction of arrow "B" is not restrained to the same degree, however, due to the greater distance between the bottle top and the first contact point of the closure acceptance area.

Figure 16:
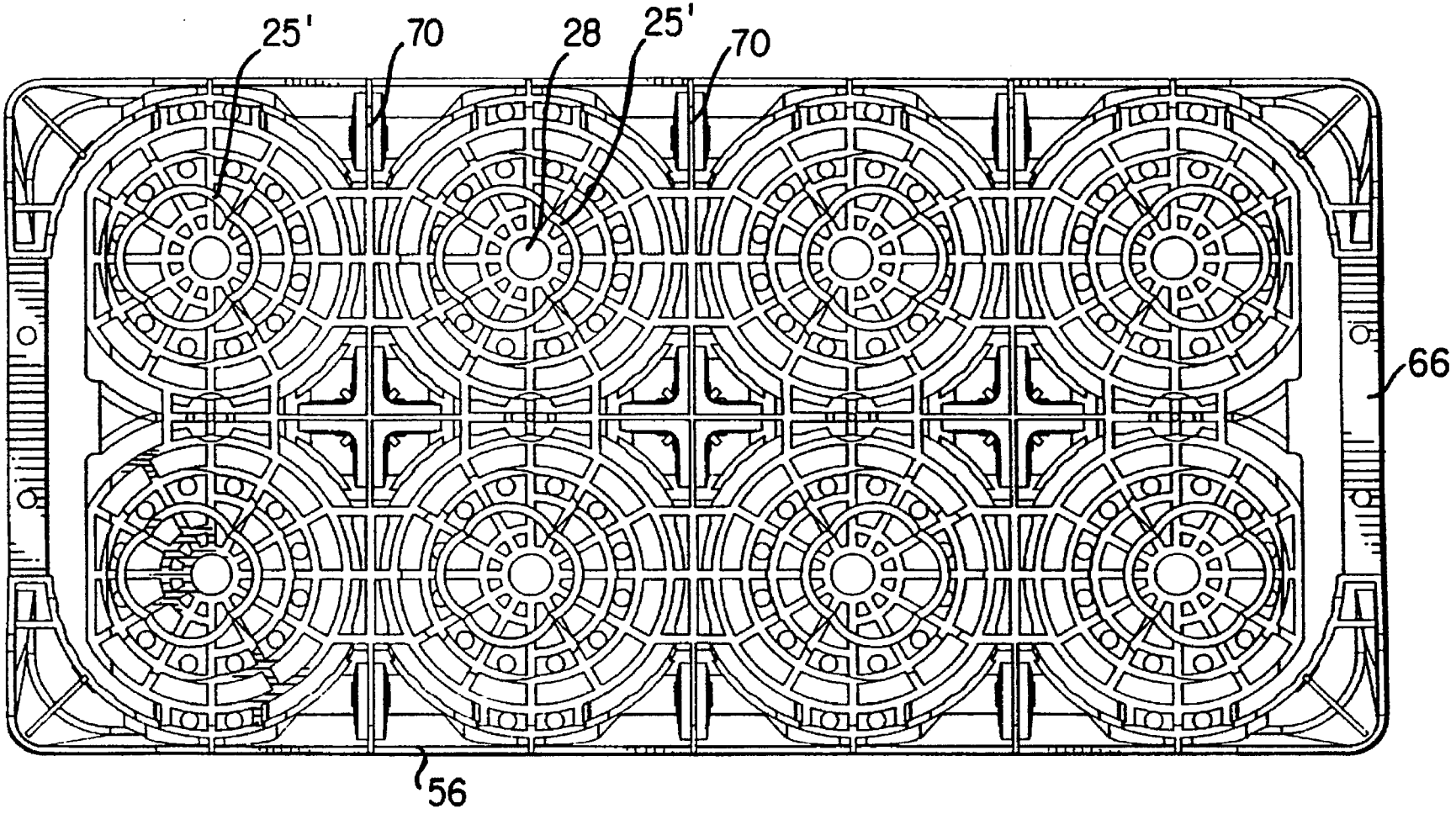
FIG. 16 is a bottom plan view of the stackable low depth case according to a preferred second embodiment of the present invention.

Therefore, in the preferred embodiment of the invention as illustrated in FIG. 16, a cloverleaf closure acceptance area 25' is utilized to ensure that there is contact around the entire perimeter of the closure acceptance area. The cloverleaf closure acceptance area 25' substantially restrains the end-to-end movement as well as the side-to-side movement of the bottles in the stacked cases.

Figure 15:
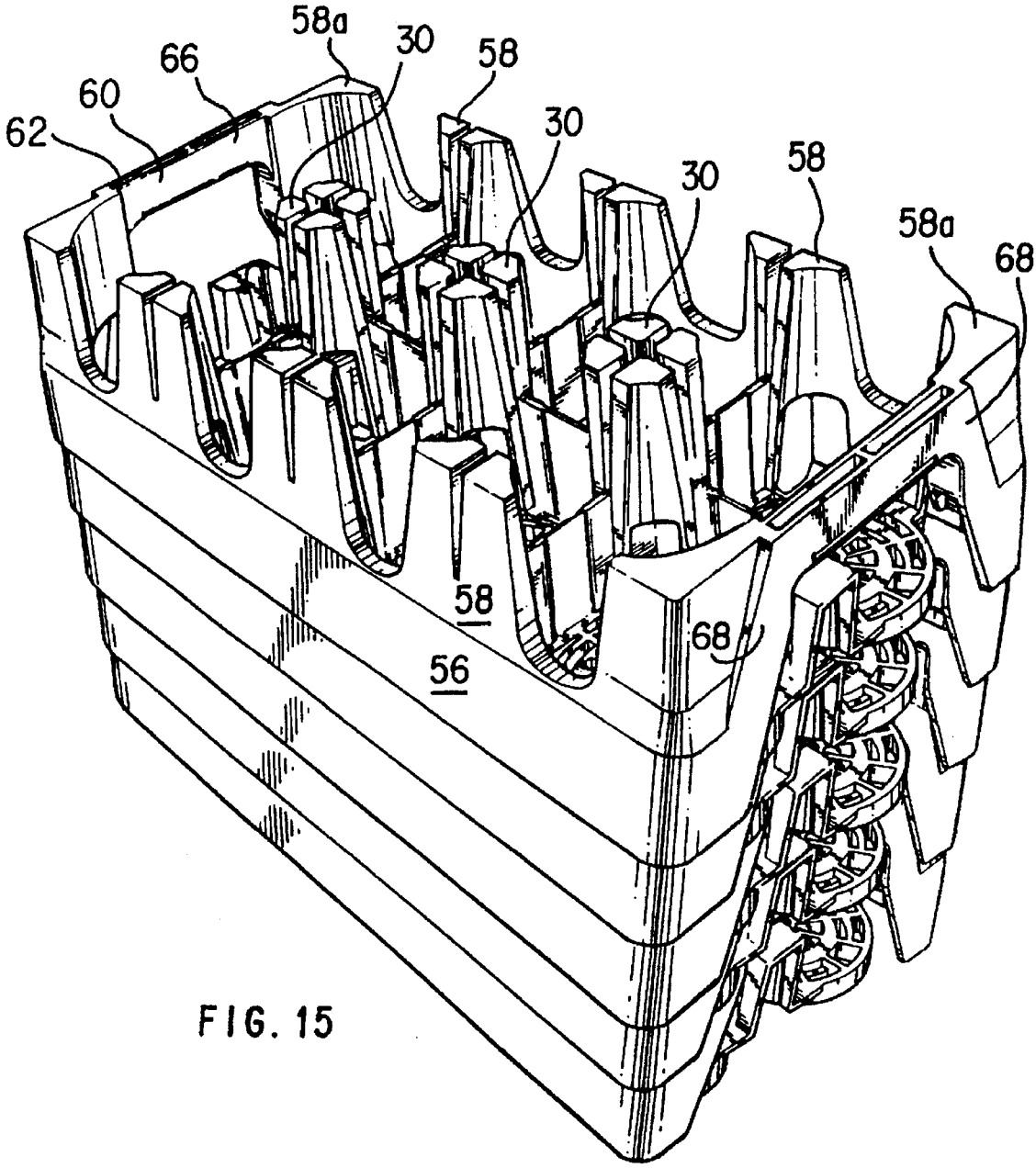
FIG. 15 is a perspective view of the case column stacked upon lower identical cases when empty.

Bottom portion 20 also includes a plurality of ribs 70 corresponding in location to recesses 42, 44, 48, 52, 54 within columns 30 and pylons 58 and extending upwards from lower surface 24 to the bottom of the recesses. As shown in FIG. 15, the correspondence between the ribs and the column and pylon recesses enables case 10 to be column nested one on top of another. This is also accomplished by having pylons 58, 58*a* and columns 30 which are angled toward the interior of the case. This means that pylons 58, 58*a* and columns 30 are tapered so that the cross sections at their tops are smaller than their cross sections nearer the lower wall portion. Pylons 58, 58*a* also cant slightly inward from the height of lower wall portions 56 to further enhance the nestability of empty cases.

The addition of ribs 56 to the bottom portion 20 reduces the size of the openings between adjacent circular concave portions 26. That is, the openings formed between adjacent ribs are sized less than the closures of the bottles to be retained, which for 2-liter bottles is generally less than 28–30 mm. The closures on most PET bottles in the market have an outer diameter of approximately 28 mm or 38 mm. Thus, when an upper case 10 is being positioned on a loaded lower case 10, the bottle tops are less likely to be caught within these smaller openings when the lower case is being slid across the tops of the bottles in the case therebelow.

End walls 14, 18 are formed by handle portions 64 to facilitate carrying case 10. Preferably for 2 liter cases, the upper surfaces of handle portions 64 are equal in height to corner pylons 58*a*, which are equal in height to pylons 58 and columns 30. Handles 64 extend integrally from corner pylons 58*a*, and comprise substantially horizontal handle bars 66 integral with handle supports 68 which extend angularly inward from the corner pylons. Handle supports 68 of each handle 64 diverge from handle bar 66 such that the handle has a generally trapezoidal configuration with the handle bar defining the short side of a trapezoid and the supports defining the diverging legs.

Figure 13:
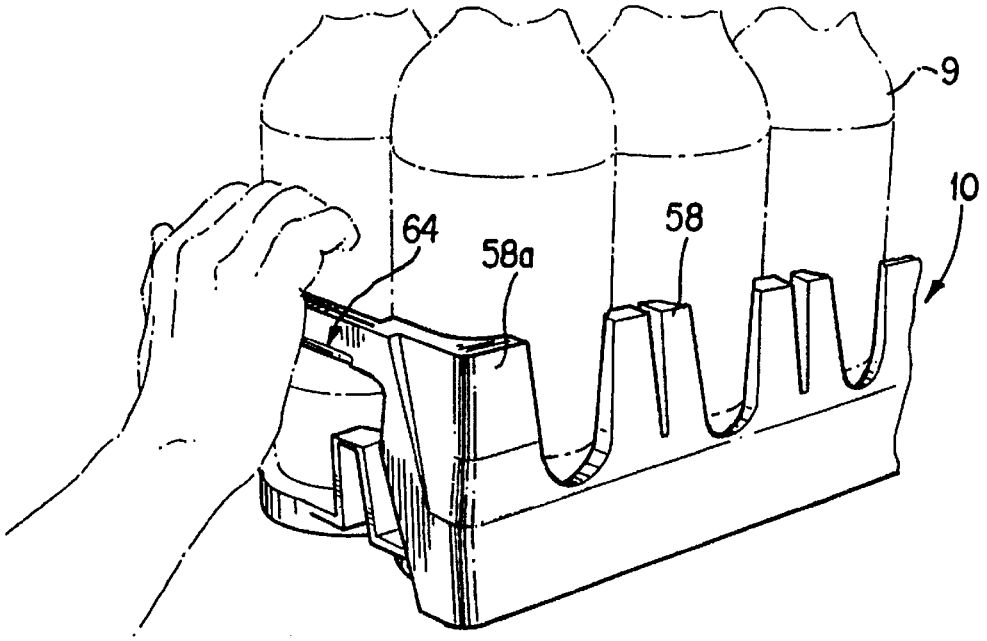
FIG. 13 illustrates the case being moved with the user's palm facing downward.
Figure 14:
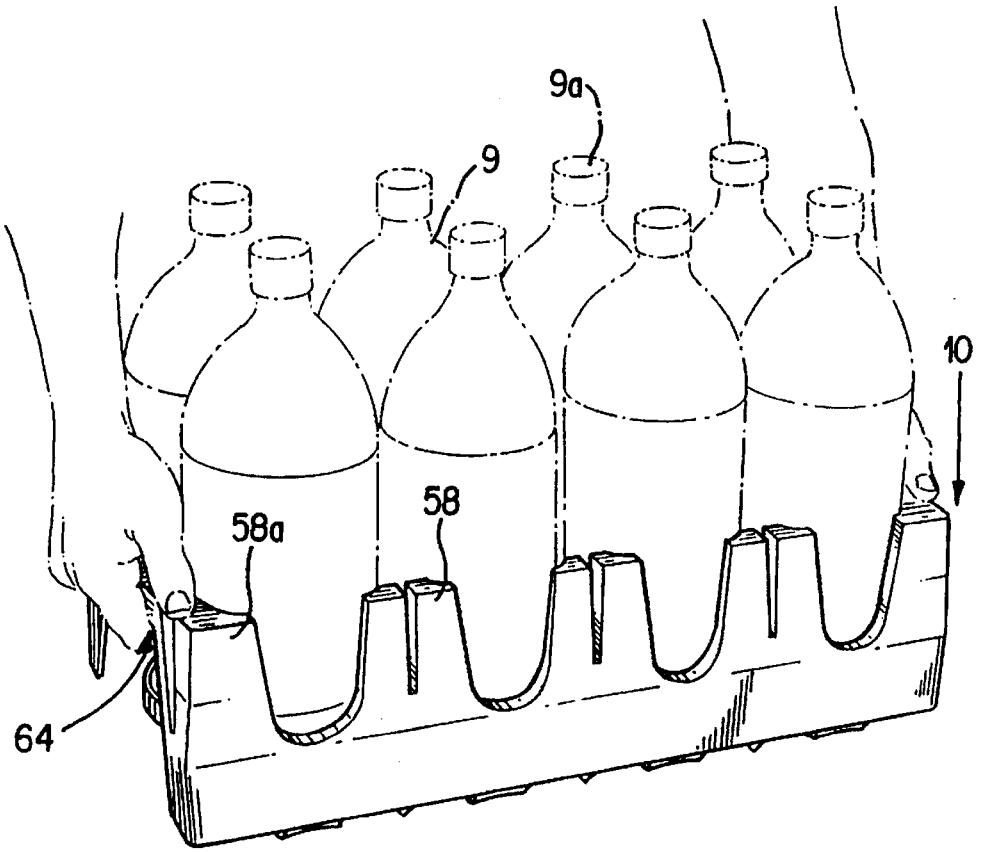
FIG. 14 illustrates the case being moved with the user's palm facing upward.

As shown in FIG. 14, handle portions 64 can be utilized to lift case 10 in the usual manner by grasping the upper edge with the palm facing upwards and the fingers curling upwards and into the case. This manner of lifting is damaging to the wrists, however, when delivery personnel are lifting a case from above their head. Therefore, the present invention also allows handle portions 64 to be gripped with the palm facing down and the fingers curling downwards around handle bar 66 as shown in FIG. 13. There are no pylons or vertical walls on end walls 14, 18 in the area immediately interior to handle bar 66 in order to assure that there is adequate space for the fingers to be inserted and curled therearound. As most clearly shown in FIGS. 1 and 3, the upwardly extending end wall member 72 is terminated below the height of vertical walls 29 in order to not interfere with the handle performance yet still restrain the movement of the loaded bottles. In a further embodiment of the invention, handle portions 64 may also have finger recesses along the upper edge and/or lower edge to further aid in carrying case 10. Still further, handle portions 64 or an alternate handle configuration may be provided on side walls 12 and 16 in addition to end walls 14 and 18 such that a gripping structure is disposed on each side of the case.

Figure 10:
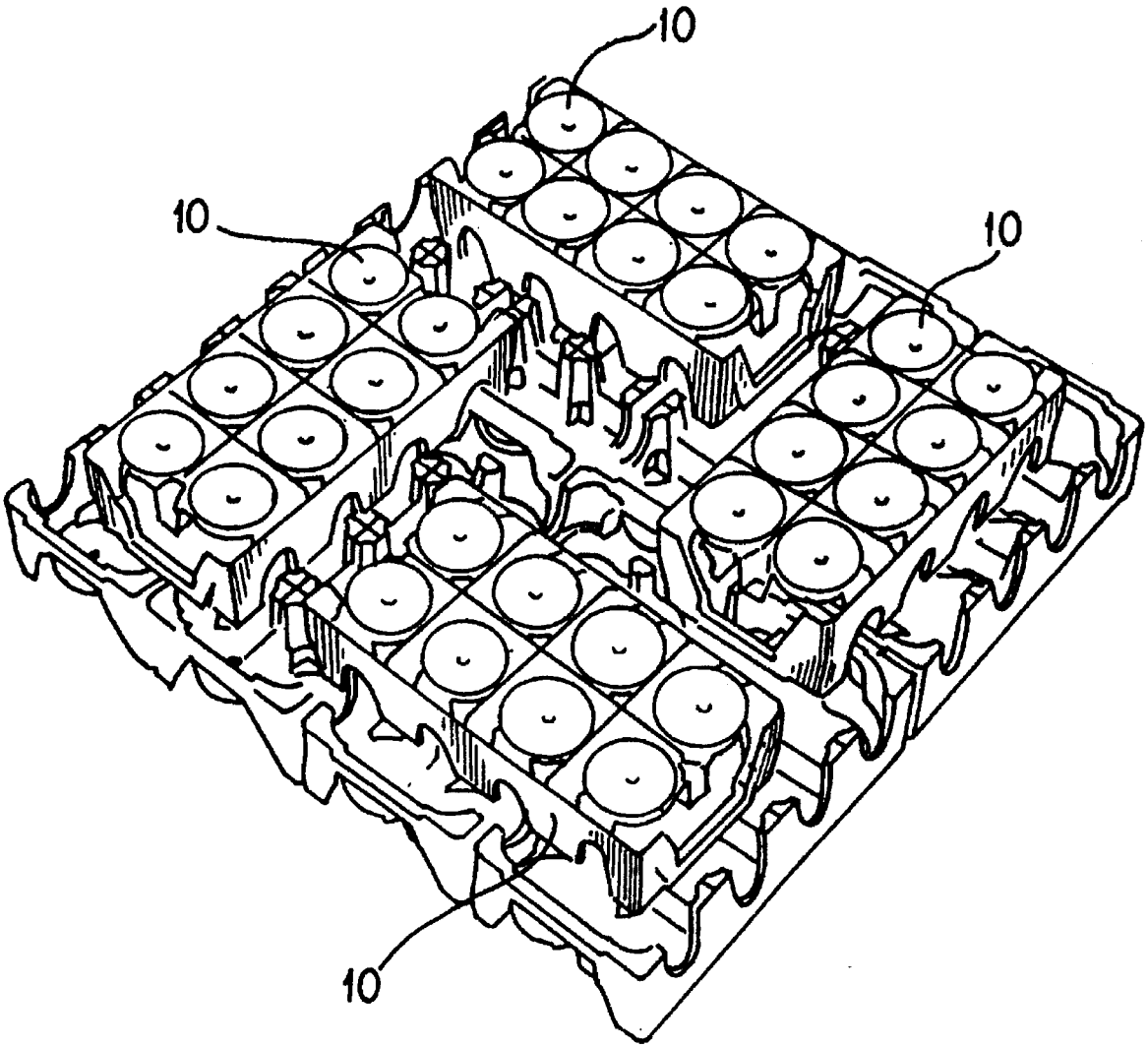
FIG. 10 is a schematic illustration of the cross-locking ability of the empty case in one configuration.
Figure 11:
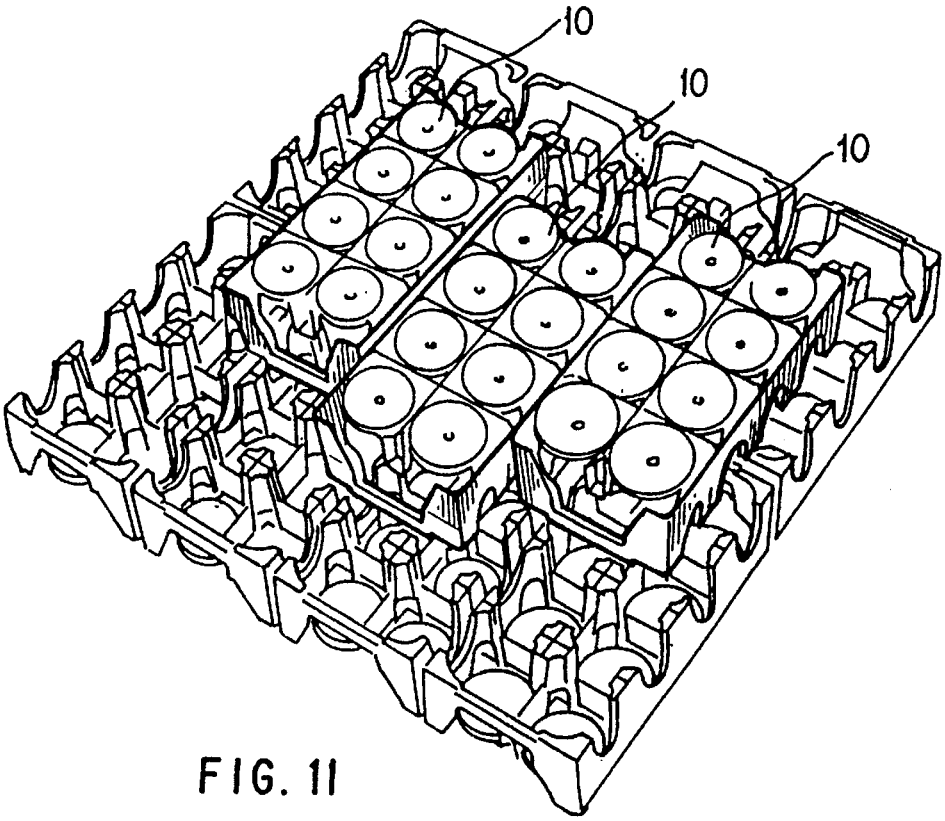
FIG. 11 is a schematic illustration of the cross-locking ability of the empty case in another configuration.
Figure 12:
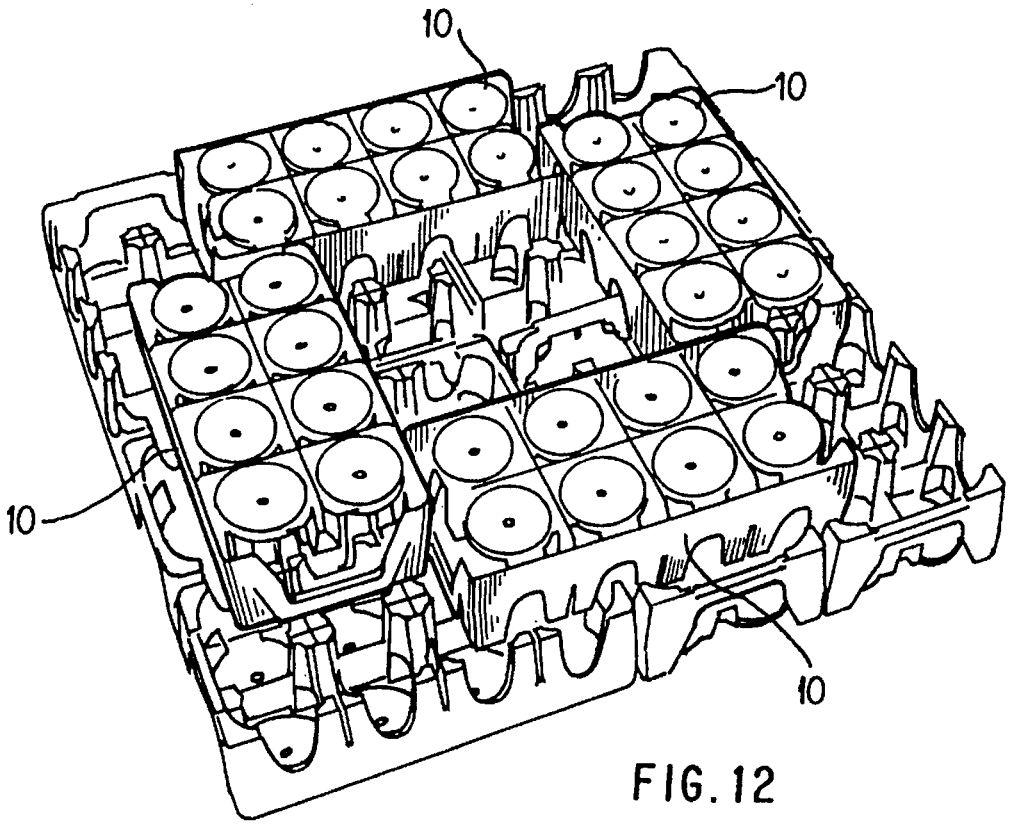
FIG. 12 is a schematic illustration of the cross-locking ability of the empty case in a further configuration.

Referring to FIGS. 10–12, a further feature of the present invention is schematically illustrated. When palletizing columns of empty cases, there is a tendency for the stacked columns to move apart and separate. To prevent this from occurring, cases 10 of the present invention can be inverted on top of the palletized load of cases in order to cross-lock the columns. FIGS. 10–12 are illustrative of various cross-locking arrangements which can be used. These are merely examples, however, and other arrangements could of course be used depending upon the size of the palletized load.

Numerous characteristics, advantages, and embodiments of the invention have been described in detail in the foregoing description with reference to the accompanying drawings. However, the disclosure is illustrative only and the invention is not limited to the precise illustrated embodiments. Various changes and modifications may be effected therein by one skilled in the art without departing from the scope or spirit of the invention.

We claim:

1. In a stackable low depth case for retaining and transporting bottles comprising opposing side walls and opposing end walls forming an outer shell having a longitudinal axis and a transverse axis; a case bottom disposed substantially within said outer shell; said improvement comprising:

said side walls including a lower wall portion and a plurality of spaced upwardly projecting pylons, four corner pylons defining four corners of said case;

a plurality of spaced upwardly projecting columns generally disposed within said outer shell defining, in combination with said case bottom, said side walls and said end walls, a plurality of bottle retaining pockets, said columns and said pylons extending above said lower wall portions and below a top surface of the retained bottles; and said end walls each comprising an integrally molded handle structure having interior and exterior surfaces suspended between an upper portion of adjacent said corner pylons, a generally open area being defined below said interior and exterior surfaces of said handle structure and between said interior surface of said handle structure and a first one of said columns such that said handle structure may be freely grasped about substantially the entire periphery thereof.

2. A stackable case as in claim 1 wherein said handle structure and said corner pylons are substantially the same height.

3. A stackable case as in claim 1 wherein said pylons and said columns define a case height and said open area below said handle structure extends a distance greater than one half said case height.

4. A stackable case as in claim 1 wherein said handle structure further includes handle support portions and a handle bar extending therebetween, said handle support potions extending inward from said corner pylons to support said handle bar at an upper surface of said pylons, and tapering outward from said handle bar to said case bottom.

5. A stackable low depth case for retaining and transporting bottles comprising:

a plurality of outer side walls forming an outer shell having a low depth, said outer shell being rectangular and having a longer length than width and having the ratio of the length to the width of said outer shell being substantially equal to the ratio of the number of bottles said case holds in a length-wise direction to the number of bottles the case holds in a widthwise direction, at least two of said outer side walls including a lower side wall portion and a plurality of spaced side members extending above an upper surface of said lower side wall portion, at least two of said outer side walls including a handle structure;

a bottom portion attached to said side walls;

a plurality of spaced central members generally disposed within said side walls defining, in combination with said bottom portion and said outer side walls, a plurality of bottle retaining pockets with at least one central member per pocket, at least some of said central members having a portion thereof which extends above a top surface of said lower side wall portions and below a top surface of the retained bottles; and said bottom portion includes:

an upper surface which is substantially flat across the bottle retaining pockets; and resting and guiding means for resting said bottom portion on closures of bottles on which said case is stacked and for guiding the closures coaxially with a centerline of said bottle retaining pockets, said resting and guiding means including a rib formation having a longitudinal centerline offset from the centerline of said bottle retaining pockets to guide closures of bottles to the center of said bottle retaining pockets;

wherein when said case is empty, said spaced members of said case interlock with an upper case when said cases are stacked, and when a subjacent case is loaded, the closures of bottles disposed in the subjacent case abut said bottom portion resting and guiding means when said cases are stacked bottom to top.

6. A stackable case as in claim 5 wherein said rib formation comprises a plurality of concentric arcuate ribs.

7. A stackable case as in claim 5 wherein said rib formation comprises a plurality of concentric circular ribs.

8. A stackable case as in claim 5 wherein said rib formation comprises a cloverleaf shape.

9. A stackable case as in claim 8 wherein said cloverleaf shape corresponds to the shape of four overlapping bottle tops.

10. A stackable case as in claim 5 wherein at least two of said outer side walls include a handle structure, said handle structure permitting grasping an upper edge thereof and pulling said case with the palm of a user facing upwards.

11. A stackable case as in claim 1 wherein said end walls and said case bottom are not structurally connected.

12. A stackable low depth case for retaining and transporting bottles comprising:

a plurality of outer side walls forming an outer shell having a low depth, said outer shell being rectangular and having a longer length than width and having the ratio of the length to the width of said outer shell being substantially equal to the ratio of the number of bottles said case holds in a length-wise direction to the number of bottles the case holds in a widthwise direction, at least two of said outer side walls including a lower side wall portion and a plurality of spaced side members extending above an upper surface of said lower side wall portion;

a bottom portion attached to said side walls;

a plurality of spaced central members generally disposed within said side walls defining, in combination with said bottom portion and said outer side walls, a plurality of bottle retaining pockets with at least one central member per pocket, at least some of said central members having a portion thereof which extends above a top surface of said lower side wall portions and below a top surface of the retained bottles; and said bottom portion includes:

an upper surface which is substantially flat across the bottle retaining pockets; and resting and guiding means for resting said bottom portion on closures of bottles on which said case is stacked and for guiding the closures coaxially with a centerline of said bottle retaining pockets, said resting and guiding means including a rib formation having a longitudinal centerline offset from the centerline of said bottle retaining pockets;

wherein when said case is empty, said spaced members of said case interlock with an upper case when said eases are stacked, and when a subjacent case is loaded, the closures of bottles disposed in the subjacent case abut said bottom portion resting and guiding means when said cases are stacked bottom to top; and wherein said rib formation comprises a cloverleaf shape.

13. A stackable case as in claim 12 wherein said cloverleaf shape corresponds to the shape of four overlapping bottle tops.

14. In a stackable low depth case for retaining and transporting bottles comprising opposing side walls and opposing end walls forming an outer shell having a longitudinal axis and a transverse axis; a case bottom disposed substantially within said outer shell; said improvement comprising:

said case bottom including opposing sides and first and second opposing ends;

wherein said opposing sides of said case bottom connect said case bottom to said side walls; and wherein said first and second opposing ends of said case bottom are spaced a predetermined distance from said end walls such that there is no structural connection therebetween.

15. A stackable case as in claim 14 wherein said end walls each comprise an integrally molded handle structure suspended between an upper portion of adjacent said corner members.

16. In a stackable low depth case for retaining and transporting bottles comprising opposing side walls and opposing end walls forming an outer shell having a longitudinal axis and a transverse axis; a case bottom disposed substantially within said outer shell; said improvement comprising:

said outer shell including four corner members defining four corners of said case;

said case bottom including a plurality of bottle supporting areas;

said end walls each comprising an integrally molded handle structure having interior and exterior surfaces suspended between an upper portion of adjacent said corner members, a generally open area being defined below said interior and exterior surfaces of said handle structure and between said interior surface of said handle structure and at least one of said bottle supporting areas such that said handle structure may be freely grasped about substantially the entire periphery thereof.

* * * * *